United States Patent [19]

Thomas

[11] Patent Number: 4,575,168

[45] Date of Patent: Mar. 11, 1986

[54] BRIDGING CLIP WITH CENTERING TAB

[75] Inventor: Stephen M. Thomas, Torrington, Conn.

[73] Assignee: The Siemon Company, Watertown, Conn.

[21] Appl. No.: 726,119

[22] Filed: Apr. 23, 1985

Related U.S. Application Data

[63] Continuation of Ser. No. 534,308, Sep. 21, 1983, abandoned.

[51] Int. Cl.[4] ..... H01R 31/08

[52] U.S. Cl. ..... 339/19

[58] Field of Search ..... 339/19, 18 C, 18 P, 339/17 LC, 222, 242

[56] References Cited

U.S. PATENT DOCUMENTS

| | | | |
|---|---|---|---|
| D. 224,406 | 7/1972 | Heck | 339/19 |
| 3,138,417 | 6/1964 | Garrett | 339/17 LC |
| 3,918,788 | 11/1975 | Walter et al. | 339/19 |
| 3,951,497 | 4/1976 | Balzano et al. | 339/19 |
| 4,015,889 | 4/1977 | Blanchet | 339/19 |

FOREIGN PATENT DOCUMENTS

| | | | |
|---|---|---|---|
| 280003 | 5/1965 | Australia | 339/19 |

OTHER PUBLICATIONS

Oriental Terminal Products Co., Ltd., 3 pages, Jumper Clip Brochure, 1-1980.

*Primary Examiner*—Neil Abrams
*Attorney, Agent, or Firm*—Fishman & Dionne

[57] ABSTRACT

A bridging clip used to interconnect a plurality of electrical terminals which are spaced apart in horizontal rows and vertical columns has incorporated therein a novel positioning means or centering tab. The centering tab provides accurate placement and alignment to avoid problems associated with short circuiting or commoning.

15 Claims, 5 Drawing Figures

BRIDGING CLIP WITH CENTERING TAB

This application is a continuation, of application Ser. No. 534,308, filed Sept. 21, 1983, now abandoned.

BACKGROUND OF THE INVENTION

This invention relates to the field of electrical bridging clips which may be used to interconnect a plurality of electrical terminals which are spaced apart in horizontal rows and vertical columns. More particularly, this invention relates to a new and improved bridge clip having a novel centering tab to effect accurate placement and self-alignment between terminals and therefore avoid undesirable electrical shorting or commoning.

Terminal connecting blocks are used extensively in the fields of electronics and communications. For example, they are used by the telephone industry in distribution cabinets for connecting conductors in a cable from an exchange to other conductors extending to various stations within a building. One type of terminal connecting block is disclosed in U.S. Pat. No. 3,234,498 and comprises a plurality of connector elements arranged in spaced horizontal rows and vertical columns of terminals in a connector block. Each element comprises a plurality of connectors joined together at a base portion. Each of the connectors is of the insulating penetrating type, i.e., the insulation on an electrical conducting wire is sheared when the wire is inserted in the connector.

It is often desired or required to interconnect a plurality of electrical terminals which are spaced apart in rows or columns. A well known connecting technique which has become widely accepted by those skilled in the art is to utilize a one-piece metal connector clip of approximate U-shape and termed a bridging clip. Bridging clips similar to the type hereinabove discussed are disclosed in U.S. Pat. No. 4,029,376 and U.S. Pat. No. Des. 224,406. U.S. Pat. No. 4,029,376 describes a plurality of bridging or connector clips separately attached at desired intervals along a longitudinal supporting means capable of interconnecting vertical columns of electrical terminals.

In many applications, it is desired to interconnect horizontal rows of electrical connectors. To accomplish this task, bridging clips with lengths large enough to span the distance between two or more electrical connectors have been available (the length being dependent on the number of connectors to be interconnected).

As previously discussed, electrical connectors similar to U.S. Pat. No. 3,234,498 comprise a plurality of fingers at particular intervals. When connecting those fingers arranged in a horizontal row, the bridging clip is visually aligned by the installer and after a downward force, is engaged by the bias action inherent in the U-shaped metal clip. Unfortunately, these bridging clips may become misaligned either by inadvertant contact made by the installer either during the initial installation or during subsequent repair work. This misalignment will cause an end portion of the bridging clip to electrically contact an adjacent electrical connector and result in undesirable electrical shorting or commoning between three connectors. For example, if a bridging clip designed to connect two adjoining connectors is inaccurately placed (not correctly centered), it is very likely that one edge of the bridging clip will contact a third adjoining connector. This unintentional touching will result in electrical contact between all three connectors and therefore short out the desired circuit.

Prior art bridging clips have attempted to solve this problem by utilizing a central window for improving visual alignment and a vertical slot running down the center of the clip for fixedly engaging the clip thereto. Unfortunately, none of these attempts have adequately overcome this time consuming and costly misalignment problem.

SUMMARY OF THE INVENTION

The above discussed and other problems of the prior art are overcome by the bridging clip of the present invention. In accordance with the present invention, a novel self-aligning centering tab is incorporated into a bridging clip thereby resulting in accurate centering between terminals and a correspondingly lower chance of electrical short circuiting or commoning.

The present invention comprises a metal U-shaped bridging clip having a stamped or cut-out window with a centering tab of indented metal integrally connected therein and centrally aligned on the clip. A centrally located longitudinal slot for secure engagement between the bridging clip and the terminal is also provided.

The above-discussed and other advantages of the present invention will be apparent to and understood by those skilled in the art from the following detailed description and drawings.

BRIEF DESCRIPTION OF THE DRAWINGS

Referring now to the drawings, wherein like elements are numbered alike in the several FIGURES.

DESCRIPTION OF THE PREFERRED EMBODIMENT

Figure 2:
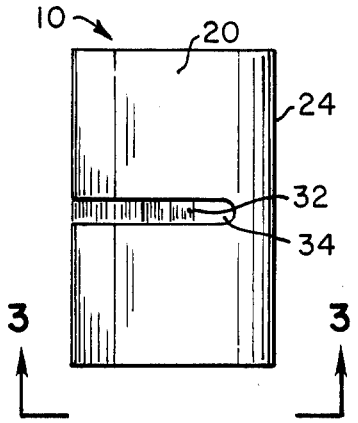
FIG. 2 is a front elevation view of the bridging clip of FIG. 1 in accordance with the present invention.
Figure 3:
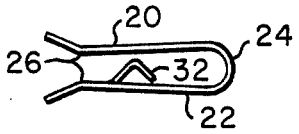
FIG. 3 is a side elevation view of the bridging clip of FIG. 1 taken along line 3—3 in accordance with the present invention.
Figure 4:
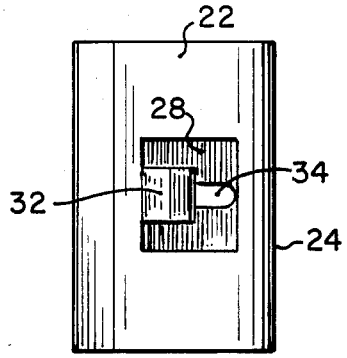
FIG. 4 is a back elevation view of the bridging clip of FIG. 1.
Figure 5:
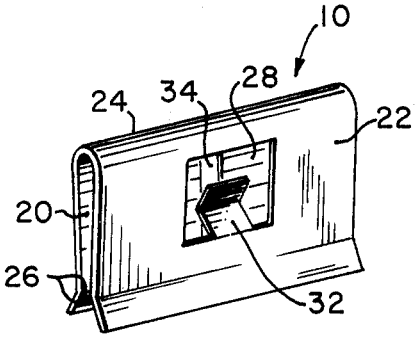
FIG. 5 is a perspective view of the bridging clip of FIG. 1 in accordance with the present invention.
Figure 1:
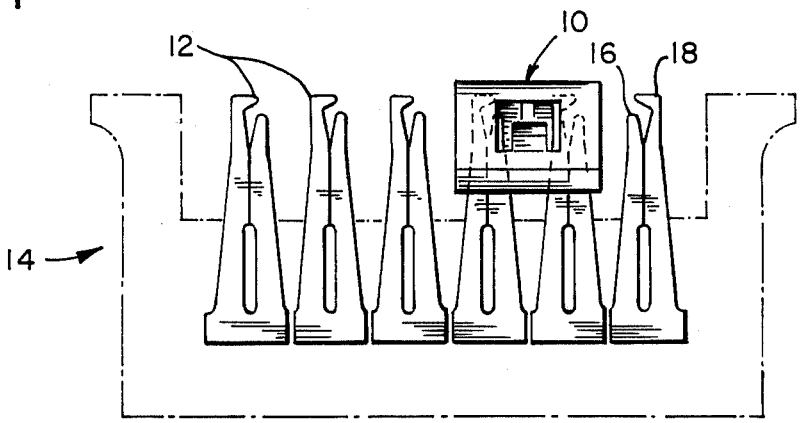
FIG. 1 is a cross-sectional elevation view of a horizontal row of individual electrical connectors having a bridging clip fixedly engaged thereto in accordance with the present invention.

Referring first to FIG. 1, a bridging clip 10 in accordance with the present invention is shown. In the drawing, the clip 10 is fixedly engaged to a conventional pair of separate electrical terminals 12. These terminals are held in a terminal block 14 which may be formed of a suitable dielectric or electrical insulating material such as a phenol-formaldehyde or a polyvinyl resin. Each terminal 12 comprises a pair of elongated fingers 16 and 18 having opposing edges for shearing insulation from a conductor which is inserted therebetween as described in detail in U.S. Pat. No. 3,234,498, the disclosure of which is incorporated herein by reference. Each of the terminals 12 may be independent as shown in FIG. 1 or two or more adjacent terminals may be joined together by means of a common base. It should be understood that each terminal 12 has an individual housing (not shown) to effect electrical insulation therebetween. Electrical conducting wires may be connected to the terminals 12 by inserting them between the elongated fingers 16 and 18.

As discussed, it is often desirable to interconnect two or more terminals 12 by the use of a bridging clip. It was noted that conventional bridging clips are easily, inadvertently misaligned or misplaced by installation and repair persons. The bridging clip 10 of the present invention shown in the FIGURES alleviates this problem by a unique positioning means or centering tab.

Referring jointly to FIGS. 1–5, bridging clip 10 is in the form of an integral piece of metal of approximate U-shape in cross-section. The outer arm portions 20 and 22 extend from the base 24 and converge toward each other for a section of their length to contact points 26 and then diverge outwardly. Note that curved base 24 may be equally as effective with a flatter shape as shown in U.S. Pat. No. Des. 224,406.

In a preferred embodiment, arm portion 22 has an approximately rectangular window 28 cut through the clip 10. This window contains an extension or centering tab 32 which extends into the window 28. Centering tab 32 has been stamped out of arm portion 22 and forms an indentation pointing inwardly towards arm portion 20. Positioned slightly above and coincident with centering tab 32 is vertical slot 34. As in previous clips, slot 34 permits the installer to fixedly engage the clip 10 between terminals 12.

Referring again to FIG. 1, during installation, the bridging clip 10 of the present invention is visually aligned between selected terminals 12 by window 28. Next, a downward force on the clip 10 is exerted whereby clip 10 undergoes a snap-fit so as to fixedly engage between the desired terminals 12 as shown in FIG. 1. This snap-fit is achieved by the natural springing action between the two arm portions 20, 22. The vertical slot 34 divides arm portion 20 in half and permits each half to act independently of the other in effecting a snug fit even if the terminals are slightly out of line. The window 28 greatly aids the installer by enhancing visual alignment as the clip and centering tab 32 is snapped into place. Upon insertion, the indentation shaped tab 32 provides accurate and exact positioning between two desired terminals.

While FIG. 1 shows a bridging clip 10 which connects two pairs of terminals 12, it will be obvious to those skilled in the art that the bridging clip of the present invention may connect any number of terminals 12 simply by providing arm portions 20, 22 which have correspondingly greater lengths. It will also be understood that window 28 and vertical slot 34 merely aid the installer in visual alignment and snug engagement respectively, and in fact, are not critical to the novel aligning snap-lock mechanism of centering tab 32.

Thus, by incorporation of the novel centering tab of the present invention, an accurate placement can be achieved when interconnecting horizontal rows of terminals 12 with bridging clips 10. The present invention therefore solves the problems associated with short circuiting or commoning of electrical terminals due to poor alignment often encountered with the use of conventional bridging clips and results in savings of time, labor and monetary costs.

While preferred embodiments have been shown and described, various modifications and substitutions may be made thereto without departing from the spirit and scope of the invention. Accordingly, it is to be understood that the present invention has been described by way of illustrations and not limitation.

What is claimed is:

1. A portable bridging clip for connecting adjacent, fixedly located electrical terminals in order to electrically bridge said terminals comprising:

a first outer arm portion;

a second outer arm portion;

a base portion connecting said arm portions;

said arm portions extending from said base, said arm portions converging toward each other for a section of their length to contact points, said arm portions flaring outwardly from said contact points, said arm portions being adapted to grippingly surround at least a pair of adjacent electrical terminals to provide electrical bridging therebetween; and means for accurately positioning said first arm portion and said second arm portion between at least two adjacent terminals, said positioning means comprising at least one centering tab, said centering tab being attached to and formed from said first outer arm portion, said centering tab being partially separated from said first outer arm portion by a step of puncturing the material of said first outer arm and thereby forming an indentation pointing inwardly towards said second outer arm portion.

2. The bridging clip of claim 1 wherein:

said centering tab is centrally located on said first outer arm portion

3. The bridging clip of claim 1 wherein said centering tab is stamped from said first outer arm portion.

4. The bridging clip of claim 1 including:

a window centrally located on said first outer arm portion wherein said centering tab is positioned within said window and whereby visual alignment during positioning is enhanced.

5. The bridging clip of claim 1 including:

a vertical slot coincident with said positioning means, said slot running longitudinally along the center of said second outer arm portion.

6. The bridging clip of claim 1 having a one piece metal construction.

7. The bridging clip of claim 1 wherein said base portion has a curved shape.

8. The bridging clip of claim 1 wherein said base portion has a flat shape.

9. A bridging clip for connecting adjacent electrical terminals comprising:

a first outer arm portion;

a second outer arm portion;

a base portion connecting said arm portions;

said arm portions extending from said base, said arm portions converging toward each other for a section of their length to contact points, said arm portions flaring outwardly from said contact points, said arm portions being adapted to grippingly surround at least a pair of adjacent electrical terminals to provide electrical bridging therebetween;

means for accurately positioning said first arm portion and said second arm portion between at least two adjacent terminals, said positioning means comprising at least one centering tab, said centering tab being attached to and formed from said first outer arm portion, said centering tab forming an indentation pointing inwardly towards said second outer arm portion; and a window centrally located on said first outer arm portion wherein said centering tab is positioned within said window and whereby visual alignment during positioning is enhanced.

10. The bridging clip of claim 9 wherein:

said centering tab is centrally located on said first outer arm portion.

11. The bridging clip of claim 9 wherein said centering tab is stamped from said first outer arm portion.

12. The bridging clip of claim 9 including:

a vertical slot coincident with said positioning means, said slot running longitudinally along the center of said second outer arm portion.

13. The bridging clip of claim 9 having a one piece metal construction.

14. The bridging clip of claim 9 wherein said base portion has a curved shape.

15. The bridging clip of claim 9 wherein said base portion has a flat shape.

* * * * *